United States Patent [19]

Hoyle et al.

[11] 4,415,334

[45] Nov. 15, 1983

[54] THERMAL DEVELOPMENT OF COLOR IN A POLYAMIDE TEXTILE MATERIAL WITH AMINOBENZENESULFONYL AZIDES

[75] Inventors: Charles E. Hoyle; Ronald S. Lenox, both of Lancaster, Pa.

[73] Assignee: Armstrong World Industries, Inc., Lancaster, Pa.

[21] Appl. No.: 427,516

[22] Filed: Sep. 29, 1982

[51] Int. Cl.[3] ..... C09B 29/00

[52] U.S. Cl. ..... 8/694; 8/666; 8/924; 8/929

[58] Field of Search ..... 8/666, 694

[56] References Cited

U.S. PATENT DOCUMENTS 4,322,211 3/1982 Hoyle et al. ..... 8/402

*Primary Examiner*—A. Lionel Clingman

[57] ABSTRACT

The present invention discloses a method of thermally developing color on a polyamide textile material. The material is first contacted with an aminobenzenesulfonyl azide and then is heated at a temperature ranging from 80° C. to the melting point of the polyamide material for an amount of time sufficient to develop a color thereon.

8 Claims, No Drawings

THERMAL DEVELOPMENT OF COLOR IN A POLYAMIDE TEXTILE MATERIAL WITH AMINOBENZENESULFONYL AZIDES

DESCRIPTION OF THE INVENTION

The invention contemplates a method of thermally developing color on a polyamide textile material. The method of the invention comprises first pretreating the material by contacting its surface with an aminobenzenesulfonyl azide of the Formula

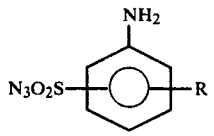

wherein, in the Formula, R is H, a $C_1$–$C_4$ alkoxy group or a $C_1$–$C_4$ alkyl group. After this pretreatment step, the material is then heated at temperatures ranging from 80° C. to the melting point of the article whereupon a color thermally develops on the article.

The term $C_1$–$C_4$ alkyl is used herein to indicate an unsubstituted straight or branched chain alkyl group having from 1 to 4 carbon atoms. The term $C_1$–$C_4$ alkoxy is used herein to indicate an unsubstituted straight or branched chain alkoxy group having from 1 to 4 carbon atoms.

The term aminobenzene azide is used herein to indicate such an azide or its mineral acid salt. The azide (or its salt) may be contacted with the polyamide material either neat or in solution.

Aminobenzenesulfonyl azides according to the Formula above may be reacted with any mineral acid to form a salt that will be suitable for use in the method of the present invention. Examples of suitable mineral acids include HBr, $H_2SO_4$ and $H_3PO_4$. HCl is the mineral salt of choice because it provides for very easy synthesis of the stable salt.

For example, hydrochloric salts which are suitable for use in the method of the present invention are prepared by treating methylene chloride solutions of the free aminobenzenesulfonyl azides with gaseous HCl. The synthesis of the aminobenzenesulfonyl azides is known (see T. Curtis, W. Stoll, *J. Prakt Chem,* 112, 1117 (1926) and British Intelligence Objective Sub-Committee, Final Report 1149, p. 24) and is quite straightforward; i.e., via the chlorosulfonation of the corresponding acetylated amines followed by condensation of the resulting sulfonyl chloride with sodium azide.

The polyamide textile materials which may be thermally colored according to the process of the present invention comprise fabrics, fibers, filaments, yarns, pellicls, flocks and the like which are produced from a linear polyamide containing recurring units of the formula:

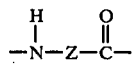

wherein Z is a member of the class consisting of a divalent hydrocarbon radical containing from 1 to about 20 carbon atoms and a divalent radical of the formula:

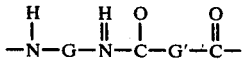

wherein G and G′ are divalent hydrocarbon radicals independently containing from 1 to about 20 carbon atoms. Particularly suitable textile materials include nylon polymers such as nylon 66, a condensation product of adipic acid and hexamethylenediamine; nylon 6, a polymer of caprolactam; nylon 4, which is based on butyrolactam (2-pyrolidone); and nylon 610, which is obtained by condensation of sebacic acid and hexamethylenediamine.

The polyamide material may be contacted with the aminobenzenesulfonyl azide, its salt, or, preferably, a solution of either in any manner that is convenient to the individual practitioner of the invention. For example, the material may be completely or partially immersed in a solution containing the azide or its salt or such a solution may be sprayed or brushed on the material. The solution may be applied to all or a portion of the material, in the latter case the solution may be applied so as to produce a decorative pattern on the material.

After being contacted with an azide solution, the material may optionally be water washed and, if desired, dried. The material is then heated at temperatures ranging from 80° C. to the melting point of the polyamide material for an amount of time sufficient to develop a color on the material. Since this technique does not interfere with the ability of the polyamide material to be dyed using conventional techniques, a thermally dyed material, such as carpet, can then be overdyed with conventional dyes if desired.

Aqueous solutions of the azide salts should be maintained at an acidic pH; i.e., no more than 7. Lower pH's, below about 2, are preferred since the aminobenzenesulfonyl azide salt dissolves more readily in water at such lower pH's. Most preferably, the pH of the solution will be below 1. Basic pH's are not suitable for the solution, as sulfonyl azides will rapidly decompose in a basic solution. Any mineral acid may be utilized to maintain the solution of the salt at an acidic pH. The term "mineral acid" is used herein to describe acids which do not dissociate to form an organic residue. Examples of suitable acids include hydrochloric acid, nitric acid, sulfuric acid, phosphoric acid and phosphorous acid.

It is understood that the practitioner of this invention can vary somewhat the color developed by varying selected factors such as the concentration of the azide or its salt in solution, the treatment contact time, the specific azide or salt being used, and/or the temperature and length of time at which the material is heated.

If an azide (or salt) solution is utilized, the temperature of such a solution is not an important parameter of this invention. Indeed, any temperature at which the solution remains in a liquid state is suitable for the purposes of this invention. However, with all other factors being identical, it has been discovered that higher solution temperatures will produce darker colors on the polyamide materials than lower solution temperature. Best results are obtained if the solution is above 60° C.

An azide solution will contain from about 0.001 to about 10 g of the azide or its salt per 100 ml of solvent. At lower concentrations, the polyamide article will have to be treated for longer periods of time in order to obtain a noticeable color change. Theoretically, concentrations of azide or its salt lower than 0.001 g/100 ml solvent may be utilized to achieve a coloration effect. However, at such low concentrations, the article may have to be treated, i.e., contacted with the solution, for very long periods of time.

The upper concentration of the azide or its salt is only limited to the amount of azide or its salt that can be put into solution. Normally, more of the azide can be put into solution as the temperature of the solution increases or if the solution is put under pressure. With all other factors being identical, it has been discovered that higher azide concentrations in the solution will produce darker colors on the polyamide material than lower azide concentrations.

The amount of time the sample should be heated to develop color on the polyamide material is dependent on parameters such as the temperature at which the sample is being heated, the concentration of the azide or its salt in solution, the temperature of solution and/or the amount of time the sample was contacted with the azide or its solution. One can, by increasing any of these parameters, lessen the amount of time the sample is to be heated to thereby develop color or the polyamide material.

Any source of heat is suitable for thermally developing color on the treated sample. For best results, the treated material should be heated at temperatures ranging from 80° C. to the melting point of the polyamide material. At temperatures below 80° C., the material will develop color only very slowly. Examples of suitable heat sources are ovens, radiant heaters, infrared lamps, and hot air streams.

The polyamide textile materials treated according to the process of the present invention may first, prior to such pretreatment steps, be secured, such as by being solvent and water washed at high temperatures, to thereby remove fiber dressing and spinning aids. This scouring and subsequent drying step is considered to be optional, and not essential, to the process of the present invention.

EXAMPLE 1

Preparation of 4-aminobenzenesulfonyl azide hydrochloride

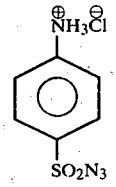

Ten grams of 4-aminobenzenesulfonyl azide was dissolved in 0.4 liters of dry methylene chloride and gaseous HCl was bubbled through the solution for 10 minutes. The insoluble salt which formed was collected by suction filtration and placed under vacuum for several hours to remove excess HCl. The product compound was formed quantitatively (11.8 g) as a white solid, which decomposed at 175°–178° C. with the evolution of gas. NMR spectra, obtained on a JEOL-H-100 Spectrometer, and IR spectra, determined on a Perkin Elmer 457 instrument, revealed the following values which are consistant with the assigned structure:

NMR (DMSO-$d_6$): 6.94 (d,2H), 7.71 (d,2H), 8.79 (s,3H, —$NH_3$).

IR (KBr): 2280 (s), 2130 (s), 1591 (m), 1489 (s), 1365 (s), 1160 (s), 1084 (s), 819 (s), 748 $cm^{-1}$ (s).

EXAMPLE 2

Preparation of 1-amino-2-methoxy-5-benzenesulfonyl azide hydrochloride

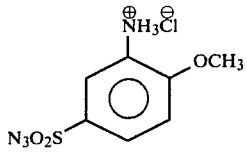

Ten grams of 3-amino-4-methoxybenzenesulfonyl azide was dissolved in 0.4 liters of dry $CH_2Cl_2$. Dry HCl gas was bubbled through the solution for 10 minutes. The resulting solid was collected and was stored under vacuum for several hours to remove excess HCl. 11.6 g of the product compound was recovered as a white solid, mp. from 184°–186° C. was observed with the evolution of gas. NMR and IR spectra revealed the following values which are consistent with the assigned structures:

NMR (DMSO-$d_6$): 3.98 (s,3H), 7.30–7.98 (m,3H), 9.47 (s,3H, —$NH_3$).

IR (KBr): 2850 (s), 2580 (s), 2058 (s), 1621 (m), 1500 (s), 1378 (s), 1279 (s), 758 (s), 608 $cm^{-1}$ (s).

EXAMPLE 3

Three pieces (4"×12") of cut pile nylon greige goods were treated for ten minutes in a boiling aqueous solution produced by adding 3.5 g of the product of Example 1 and 12 ml of concentrated HCl to 1000 ml of deionized water. Each piece of greige goods was thoroughly rinsed and dried. When dried, each piece of greige goods was exposed for 30–60 seconds at a distance of 6" from the heating surface of a 1500 watt radiant heater. The greige goods developed a deep purple-brown color which penetrated about half way down each tuft. These colored greige goods were then overdyed with red and blue dyes to produce dyed samples where the tips of the tufts were darker in color than the base.

EXAMPLE 4

A 6"×6" piece of cut pile Nylon 66 greige goods was treated for 5 minutes in a 100° solution composed of 2 g of the product compound of Example 1, 25 ml concentrated HCl and 600 ml water. After the greige goods were rinsed and dried, the greige goods were heated at 170° C. in an oven until a deep purple color had developed in the Nylon yarn.

EXAMPLE 5–16

These examples were conducted to see if there was any degradation of Nylon 66 yarn, as evidenced by a marked reduction in the yarns breaking strength, caused by treating the yarn with the hydrochloride salt of 4-aminobenzenesulfonyl azide. Treatments were done, using various solutions, on several 1 gram samples of DuPont BCF 1325-88-0-746 Brt yarn. After being treated, the yarns were rinsed, dried and then subject to breaking strength tests. The results were compared against untreated controls. The TABLE sets forth the treatment conditions for each of the Examples and the breaking strength of each of the Examples and the controls.

TABLE

| Example | Yarn Treatment Solution | Treatment Time (min) | Treatment Temp (°C.) | Breaking Strength (lb.) |
|---|---|---|---|---|
| 5 | 10 ml solution A & 50 ml $H_2O$ | 5 | 100° | 8.78 |
| 6 | 10 ml solution A & 50 ml $H_2O$ | 5 | 100° | 8.89 |
| 7 | 10 ml solution A & 50 ml $H_2O$ | 10 | 100° | 8.64 |
| 8 | 10 ml solution A & 50 ml $H_2O$ | 10 | 100° | 8.64 |
| 9 | 10 ml solution A & 50 ml $H_2O$ | 2 | 100° | 8.92 |
| 10 | 10 ml solution A & 50 ml $H_2O$ | 2 | 100° | 8.65 |
| 11 | 10 ml solution B & 50 ml $H_2O$ | 5 | 100° | 8.92 |
| 12 | 10 ml solution B & 50 ml $H_2O$ | 5 | 100° | 8.95 |
| 13 | 10 ml solution B & 50 ml $H_2O$ | 2 | 100° | 9.03 |
| 14 | 10 ml solution B & 50 ml $H_2O$ | 2 | 100° | 8.71 |
| 15 | 10 ml solution B & 50 ml $H_2O$ | 10 | 100° | 8.72 |
| 16 | 10 ml solution B & 50 ml $H_2O$ | 10 | 100° | 8.70 |
| Control A | — | — | — | 8.80 |
| Control B | — | — | — | 8.92 |

Solution A: 2.0 g of the hydrochloride salt of 4-aminobenzenesulfonyl azide in sufficient 1.0M HCl to make 100 ml solution.

Solution B: 1.0g of the hydrochloride salt of 4-aminobenzenesulfonyl azide in sufficient 1.0M HCl to make 100 ml solution.

The results of these Examples clearly indicate that treating the yarn according to the process of the present invention does not cause degradation of the yarn.

What is claimed is:

1. A method of thermally developing color on a polyamide material, which comprises treating the material by contacting it with an aminobenzenesulfonyl azide of the formula

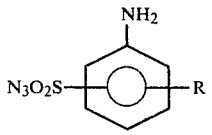

wherein R is H, a $C_1$–$C_4$ alkoxy group or a $C_1$–$C_4$ alkyl group, or a salt thereof, and heating the treated material at a temperature ranging from 80° C. to the melting point of the polyamide material to thereby develop color on the material.

2. The method of claim 1 wherein the aminobenzenesulfonyl azide or its salt is in solution.

3. The method of claim 2 wherein the solution contains from 0.001 to 10 grams of the azide or its salt per 100 ml of solvent.

4. The method of claim 1 wherein the material is contacted with an aqueous solution of the aminobenzenesulfonyl salt.

5. The method of claim 4 wherein the pH of the solution is less than about 2.

6. The method of claim 1 wherein the material is contacted with aminobenzenesulfonyl azide hydrochloride salt.

7. The method of claim 5 wherein R represents H.

8. The method of claim 5 wherein R represents $OCH_3$.

* * * * *